US012480188B2

(12) United States Patent
Perlade et al.

(10) Patent No.: US 12,480,188 B2
(45) Date of Patent: Nov. 25, 2025

(54) HIGH TOUGHNESS HOT ROLLED STEEL SHEET AND METHOD OF MANUFACTURING THE SAME

(71) Applicant: ArcelorMittal, Luxembourg (LU)

(72) Inventors: Astrid Perlade, Le Ban-Saint-Martin (FR); Kangying Zhu, Metz (FR); Coralie Jung, Metz (FR); Frederic Kegel, Yutz (FR)

(73) Assignee: ArcelorMittal, Luxembourg (LU)

( * ) Notice: Subject to any disclaimer, the term of this patent is extended or adjusted under 35 U.S.C. 154(b) by 531 days.

(21) Appl. No.: 17/784,812

(22) PCT Filed: Dec. 17, 2020

(86) PCT No.: PCT/IB2020/062111
§ 371 (c)(1),
(2) Date: Jun. 13, 2022

(87) PCT Pub. No.: WO2021/124199
PCT Pub. Date: Jun. 24, 2021

(65) Prior Publication Data

US 2023/0027001 A1 Jan. 26, 2023

(30) Foreign Application Priority Data

Dec. 19, 2019 (WO) ..... PCT/IB2019/061095

(51) Int. Cl.

| | |
|---|---|
| ***C22C 38/04*** | (2006.01) |
| ***C21D 8/02*** | (2006.01) |
| ***C22C 38/02*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/38*** | (2006.01) |

(52) U.S. Cl.
CPC ..... *C22C 38/04* (2013.01); *C21D 8/0205* (2013.01); *C22C 38/02* (2013.01); *C22C 38/06* (2013.01); *C22C 38/22* (2013.01); *C22C 38/26* (2013.01); *C22C 38/28* (2013.01); *C22C 38/38* (2013.01)

(58) Field of Classification Search
CPC ..... C22C 38/04; C22C 38/02; C22C 38/06; C22C 38/22; C22C 38/26; C22C 38/28; C22C 38/38; C22C 38/32; C22C 38/001; C22C 38/12; C22C 38/14; C22C 38/34; C21D 8/0205; C21D 2211/001; C21D 2211/002; C21D 2211/008; C21D 8/0226; B23K 11/11
See application file for complete search history.

(56) References Cited

U.S. PATENT DOCUMENTS

| | | | |
|---|---|---|---|
| 2005/0199322 | A1 | 9/2005 | Nakamura et al. |
| 2009/0107588 | A1 | 4/2009 | Sebastien et al. |
| 2013/0319582 | A1 | 12/2013 | Yokoi et al. |
| 2015/0329950 | A1 | 11/2015 | Azuma et al. |
| 2016/0273066 | A1 | 9/2016 | Sakakibara et al. |
| 2018/0237874 | A1 | 8/2018 | Yamazaki et al. |
| 2018/0371566 | A1 | 12/2018 | Gospodinova et al. |
| 2019/0040482 | A1 | 2/2019 | Kimata et al. |
| 2020/0149129 | A1* | 5/2020 | Beauvais ..... C21D 8/0473 |

FOREIGN PATENT DOCUMENTS

| | | | |
|---|---|---|---|
| CN | 106471147 | A | 3/2017 |
| CN | 107849663 | A | 3/2018 |
| EP | 2631307 | A1 | 8/2013 |
| EP | 2698440 | A1 | 2/2014 |
| EP | 2752500 | A1 | 7/2014 |
| EP | 3112488 | A1 | 1/2017 |
| EP | 3550047 | A1 | 10/2019 |
| JP | 2005271033 | | 10/2005 |
| JP | 2005290547 | A | 10/2005 |
| JP | 2014180698 | | 9/2014 |
| JP | 2014205889 | A | 10/2014 |
| JP | 2015063731 | A | 4/2015 |
| WO | WO2007101921 | | 9/2007 |
| WO | WO 2016001703 | A1 | 1/2016 |
| WO | WO 2016/187576 | A1 | 11/2016 |
| WO | WO2017138503 | A1 | 8/2017 |
| WO | WO 2018/055425 | A1 | 3/2018 |

(Continued)

OTHER PUBLICATIONS

Search Report of PCT/IB2020/062004 dated Jan. 2, 2021.
Written Opinion of PCT/IB2020/062004.
Search Report of PCT/IB2019/062111 dated Feb. 17, 2021.
Written Opinion of PCT/IB2020/062111.
Search Report of PCT/IB2019/062011 dated Sep. 2, 2021.
Written Opinion of PCT/IB2020/062011.
Search Report of PCT/IB2020/062116 dated Feb. 22, 2021.
Written Opinion of PCT/IB2020/062116.
Cooman De B C et al., "Quench and Partitioning Steel: A New AHSS Concept for Automotive Anti-Intrusion Applications", Steel Research International, Verlag Stahleisen GMBH., Dusseldorf, DE, (Sep. 1, 2006), vol. 77, No. 9/10, ISSN 1611-3683, pp. 634-640.

*Primary Examiner* — Michael E Barr
(74) *Attorney, Agent, or Firm* — Davidson Kappel LLC

(57) ABSTRACT

A hot rolled steel sheet having a composition including, by weight percent: C: 0.10-0.25%, Mn: 3.5-5.0%, Si: 0.80-1.60%, B: 0.0003-0.004%, S≤0.010%, P≤0.020%, N≤0.008% the remainder of the composition being iron and unavoidable impurities resulting from the smelting, and having a microstructure consisting of, in surface fraction: between 50% and 80% of lath bainite, lower than 30% of granular bainite, the rest being martensite, martensite-austenite islands and austenite films, and having less than 20% of martensite and M-A islands having the multiplication of the maximum length $L_{max}$ of the grain by the maximum width $W_{max}$ of the grain higher than 1 $\mu m^2$.

11 Claims, No Drawings

(56) References Cited

FOREIGN PATENT DOCUMENTS

| | | | |
|---|---|---|---|
| WO | WO 2018/162937 | | 9/2018 |
| WO | WO 2018220430 | A1 | 12/2018 |
| WO | WO2019/111029 | A1 | 6/2019 |
| WO | WO 2019/123240 | A2 | 6/2019 |
| WO | WO 2019/123245 | A1 | 6/2019 |
| WO | WO 2021/124132 | A1 | 6/2021 |
| WO | WO 2021/ 124199 | A1 | 6/2021 |
| WO | WO 2021/124203 | A1 | 6/2021 |
| WO | WO2021124136 | A1 | 6/2021 |

* cited by examiner

HIGH TOUGHNESS HOT ROLLED STEEL SHEET AND METHOD OF MANUFACTURING THE SAME

The present invention relates to a high strength steel sheet having high toughness and good weldability and to a method to obtain such steel sheet.

BACKGROUND

To manufacture various items such as parts of body structural members and body panels for automotive vehicles, it is known to use sheets made of DP (Dual Phase) steels or TRIP (Transformation Induced Plasticity) steels.

One of the major challenges in the automotive industry is to decrease the weight of vehicles in order to improve their fuel efficiency in view of global environmental conservation, without neglecting the safety requirements. To meet these requirements, new high strength steels are continuously developed by the steelmaking industry, to have sheets with improved yield and tensile strengths, and good ductility and formability.

SUMMARY OF THE INVENTION

One development made to improve mechanical properties is to increase manganese content in steels. The presence of manganese helps to increase ductility of steels thanks to the stabilization of austenite. But these medium manganese steels present weaknesses of brittleness.

The publication WO2007101921 describes a method to obtain hot rolled sheets of steels "multiphase", with in particular, a manganese content comprised between 1% and 3%. The microstructure consists of at least 75% bainite, residual austenite in an amount greater than or equal to 5% and martensite greater than or equal to 2%. To attain a Charpy V notch fracture energy greater than 28 J (corresponding to 0.52 J/mm$^2$) and the targeted microstructure, the cooling of the hot rolled steel sheet must be controlled. Two cooling stages are actually necessary to obtain the desired properties, which complicates the manufacturing process.

It is an object of the present invention to provide a steel sheet having high toughness with Charpy impact energy at 20° C. higher than 0.50 J/mm$^2$, tensile strength TS above or equal to 1450 MPa, high uniform elongation above or equal to 5%, and easily processable on a conventional process route. Another purpose of the invention is to provide a steel sheet having good weldability.

The present invention provides a hot-rolled steel sheet, made of a steel having a composition comprising, by weight percent:

C: 0.10-0.25%
Mn: 3.5-5.0%
Si: 0.80-1.60%
B: 0.0003-0.004%
S≤0.010%
P≤0.020%
N≤0.008% and comprising optionally one or more of the following elements, in weight percentage:

Ti≤0.04%
Nb≤0.05%
Mo≤0.3%
Al≤0.90%
Cr≤0.80% the remainder of the composition being iron and unavoidable impurities resulting from the smelting, said steel sheet having a microstructure comprising, in surface fraction, from 50% to 80% of lath bainite with an aspect ratio above or equal to 3, lower than 30% of granular bainite with an aspect ratio below 3, the rest being martensite, martensite-austenite M-A islands having an aspect ratio below or equal to 2, and austenite films, the sum of which being from 15% to 35%, and less than 20% of said martensite and said M-A islands having the multiplication of the maximum length $L_{max}$ of the grain by the maximum width $W_{max}$ of the grain higher than 1 μm$^2$.

The present invention also provides a method for manufacturing a hot-rolled steel sheet, comprising the following successive steps:

casting a steel to obtain a semi-product, said semi product having a composition as described above, reheating the semi-product at a temperature $T_{reheat}$ comprised between 1150° C. and 1300° C., hot rolling the semi-product with a finish hot rolling temperature between 750° C. and 900° C. to obtain a hot-rolled steel sheet, cooling the hot rolled steel sheet, coiling the hot rolled steel sheet at a coiling temperature $T_{coil}$ comprised between (Ms−100° C.) and 550° C. so to obtain a coiled steel sheet.

A resistance spot weld of two steel parts of the hot rolled steel sheet described above or obtained through the method as described above, said resistance spot weld having an α value of at least 50 daN/mm$^2$ and a plug ratio of at least 80%.

DETAILED DESCRIPTION OF

The invention will now be described in detail and illustrated by examples without introducing limitations.

Hereinafter, Ms designates the martensite start temperature, i.e. the temperature at which the austenite begins to transform into martensite upon cooling. This temperature can be calculated from a formula, based on the weight percent of the corresponding elements:

$$Ms=560-(30*\%\ Mn+13*\%\ Si-15*\%\ Al+12*\%\ Mo)-600*(1-\exp(-0.96*\%\ C))$$

The composition of the steel according to the invention will now be described, the content being expressed in weight percent.

The carbon content is comprised between 0.10% and 0.25%. If the carbon content is too high, the weldability of the steel sheet is insufficient. If the carbon content is lower than 0.10%, the austenite fraction is not stabilized enough to obtain targeted properties. In a preferred embodiment of the invention, the carbon content is between 0.15% and 0.20%.

The manganese content is comprised between 3.5% and 5.0%. Above 5.0% of addition, the risk of central segregation increases to the detriment of the toughness. Below 3.5%, the final structure comprises an insufficient retained austenite fraction to obtain the desired properties. In a preferred embodiment of the invention the manganese content is between 3.5% and 4.5%.

According to the invention, the silicon content is comprised between 0.80% and 1.60%. A silicon addition of at least 0.80% helps to stabilize a sufficient amount of retained austenite. Above 1.60%, silicon is detrimental for toughness.

Moreover, silicon oxides form at the surface, which impairs the coatability of the steel. In a preferred embodiment of the invention, the silicon content is between 1.00% and 1.60%.

According to the invention, the boron content is comprised between 0.0003% and 0.004%. The presence of boron delays bainitic transformation to a lower temperature and the bainite formed at low temperature has a lath morphology which increases the toughness. Moreover, boron improves weldability of the steel sheet. Above 0.004%, the formation of borocarbides at the prior austenite grain boundaries is promoted, making the steel more brittle. Below 0.0003%, there is not a sufficient concentration of free B that segregates at the prior austenite grain boundaries to increase toughness of the steel. In a preferred embodiment of the invention, the boron content is between 0.001% and 0.003%.

Optionally some elements can be added to the composition of the steel according to the invention.

Titanium can be added optionally up to 0.04% to provide precipitation strengthening. Preferably a minimum of 0.01% of titanium is added in addition of boron to protect boron against the formation of BN.

Niobium can be added up to 0.05% to refine the austenite grains during hot-rolling and to provide precipitation strengthening. Preferably, the minimum amount of niobium added is 0.0010%.

Molybdenum can optionally be added, in a limit of maximum 0.3%. Molybdenum stabilizes the austenite and increases toughness of the steel. Moreover, molybdenum improves weldability of the steel sheet. Above 0.3%, the addition of molybdenum is costly and ineffective in view of the properties which are required.

Aluminium can optionally be added up to 0.90%, as it is a very effective element for deoxidizing the steel in the liquid phase during elaboration. Moreover, aluminium improves weldability of the steel sheet. The aluminium content is lower than 0.90% to avoid the occurrence of inclusions and to avoid oxidation problems. Preferably, the aluminium content is comprised between 0.10% and 0.90%. More preferably, the aluminium content is comprised between 0.20% and 0.90%. More preferably, the aluminium content is comprised between 0.30% and 0.90%, even more between 0.40% and 0.90%.

According to the invention, a maximum of 0.80% of chromium is allowed. Above, a saturation effect is noted, and adding chromium is both useless and expensive.

The remainder of the composition of the steel is iron and impurities resulting from the smelting. In this respect, P, S and N at least are considered as residual elements which are unavoidable impurities. Their content is less than 0.010% for S, less than 0.020% for P and less than 0.008% for N.

In particular phosphorus segregates at grain boundary and for a phosphorus content higher than 0.020%, the toughness of the steel is reduced.

The microstructure of the hot rolled steel sheet according to the invention will now be described. Hereinafter, the aspect ratio is the ratio of the maximum length $L_{max}$ of a grain to the maximum width $W_{max}$ of the grain measured at 90° of said maximum length.

The hot rolled steel sheet has a microstructure consisting of, in surface fraction, between 50% and 80% of lath bainite, lower than 30% of granular bainite, and the rest being martensite, martensite-austenite islands (M-A) and austenite films, the sum of which being comprised from 15% to 35%. Moreover, less than 20% of martensite and M-A islands have the multiplication of the maximum length $L_{max}$ of the grain by the maximum width $W_{max}$ of the grain higher than 1 $\mu m^2$.

The lath bainite morphology is obtained thanks to the presence of boron delaying bainitic transformation and thanks to the low temperature coiling. According to the present invention, the lath bainite will be a bainite having an aspect ratio above or equal to 3. The presence between 50% and 80% of lath bainite is beneficial for toughness of the hot rolled steel. Granular bainite presents an aspect ratio below 3.

The rest of microstructure comprises martensite, M-A islands and austenite films, the sum of which being comprised from 15% to 35%, to ensure a uniform elongation above 5%. Above 35% of the sum of martensite, M-A islands and austenite films, the austenite in M-A islands and austenite films become instable and transform into martensite, which leads to a degradation of elongation.

Less than 20% of the fraction of martensite and M-A islands have the multiplication of $L_{max}$ by $W_{max}$ higher than 1 $\mu m^2$. Above 20%, the M-A islands transform into fresh martensite, leading to a degradation of elongation. Martensite-austenite (M-A) islands have aspect ratio below or equal to 2. These M-A islands develop during coiling. A part of the austenite is transformed in lath bainite as described above. Part of the austenite transforms in martensite generating M-A islands during coiling. A last part of the austenite remains in the final microstructure. Austenite films are austenite between bainite laths with an aspect ratio above or equal to 2. Both M-A islands and austenite films are beneficial for toughness of the hot rolled steel sheet.

The hot-rolled steel sheet according to the invention has Charpy impact energy at 20° C. strictly higher than 0.50 $J/mm^2$ measured according to Standard ISO 148-1:2006 (F) and ISO 148-1:2017(F). The hot rolled steel sheet according to the invention has tensile strength TS above or equal to 1450 MPa, and uniform elongation UE above or equal to 5%. Preferably the hot rolled steel sheet according to the invention has total elongation TE strictly higher than 7%. TS, UE and TE are measured according to ISO standard ISO 6892-1.

The steel sheet according to the invention can be produced by any appropriate manufacturing method and the person skilled in the art can define one. It is however preferred to use the method according to the invention comprising the following steps:

A semi-finished product able to be further hot-rolled, is provided with the steel composition described above. The semi-finished product is heated to a temperature comprised between 1150° C. and 1300° C., so to make it possible to ease hot rolling, with a final hot rolling temperature FRT comprises from 750° C. to 900° C. Preferably, the FRT is comprised between 800° C. and 900° C. When FRT is higher than 900° C., the bainite transformation kinetics slows down significantly during coiling, leading to the formation of a high fraction of martensite, M-A islands and austenite in the final microstructure. In addition, the presence of a large fraction of martensite and M-A islands having $L_{max}*W_{max}$ higher than 1 $\mu m^2$, leads to a degradation in elongation.

The hot-rolled steel is then cooled and coiled at a temperature Tam comprised between (Ms−100° C.) and 550° C.

The hot rolled steel sheet is then cooled to room temperature.

After the coiling, the sheet can be pickled to remove oxidation.

An other purpose of the invention is to provide a steel sheet having good weldability.

The welded assembly is manufactured by producing two sheets of hot rolled steel, and resistance spot welding the two steel parts.

Spot welding in standard ISO 18278-2 condition have been done on the hot rolled steel sheets.

In the test used, the samples are composed of two sheets of steel in the form of cross welded equivalent. A force is applied so as to break the weld point. This force, known as cross tensile Strength (CTS), is expressed in daN. It depends on the diameter of the weld point and the thickness of the metal, that is to say the thickness of the steel and the metallic coating. It makes it possible to calculate the coefficient α which is the ratio of the value of CTS on the product of the diameter of the welded point multiplied by the thickness of the substrate. This coefficient is expressed in daN/mm$^2$.

The plug ratio is equal to the plug diameter divided by the molten zone diameter.

The resistance spot welds joining the first sheet to the second sheet are characterized by a high resistance in cross-tensile test defined by an α value of at least 50 daN/mm2, and a plug ratio of at least 80%.

The invention will be now illustrated by the following examples, which are by no way limitative.

Example 1

4 grades, whose compositions are gathered in table 1, were cast in semi-products and processed into steel sheets

TABLE 1

Compositions
The tested compositions are gathered in the following table wherein the element contents are expressed in weight percent.

| Steel | C | Mn | Si | B | S | P | N | Ti | Nb | Mo | Al | Cr | Ms (° C.) |
|---|---|---|---|---|---|---|---|---|---|---|---|---|---|
| A | 0.17 | 3.7 | 1.03 | 0.0019 | 0.001 | 0.014 | 0.004 | 0.025 | 0 | 0.21 | 0.81 | 0.5 | 355 |
| B | 0.19 | 3.9 | 1.27 | 0.0021 | 0.001 | 0.011 | 0.004 | 0.029 | 0.02 | 0.20 | 0.39 | 0 | 330 |
| C | 0.18 | 3.5 | 0.97 | 0 | 0.001 | 0.013 | 0.004 | 0 | 0.03 | 0.20 | 0 | 0 | 345 |
| D | 0.17 | 3.6 | 1.01 | 0 | 0.001 | 0.016 | 0.004 | 0 | 0 | 0 | 0 | 0 | 349 |

Steels A and B are according to the invention, C and D out of the invention.

TABLE 2

Process parameters
Steel semi-products, as cast, were reheated at 1200° C., hot rolled, and coiled.
The following specific conditions were applied:

| Trial | Steel | FRT (° C.) | $T_{Coil}$ (° C.) |
|---|---|---|---|
| 1 | A | 900 | 450 |
| 2 | B | 830 | 450 |
| 3 | B | 845 | 500 |
| 4 | B | 910 | 500 |
| 5 | C | 900 | 450 |
| 6 | D | 900 | 450 |

Underline values: not corresponding to the invention

The hot rolled sheets were then analyzed and the corresponding microstructure elements, mechanical properties and weldability properties were respectively gathered in tables 3, 4 and 5.

TABLE 3

Microstructure of the hot rolled steel sheet
The phase percentages of the microstructures of the obtained hot rolled steel sheet were determined:

| Trials | Lath Bainite (%) | Martensite + M-A + austenite (%) | Granular Bainite (%) | Fraction of martensite and M-A islands having $L_{max} * W_{max} > 1$ μm$^2$ (%) |
|---|---|---|---|---|
| 1 | 75 | 25 | — | 14 |
| 2 | 77 | 23 | — | 12 |
| 3 | 75 | 25 | — | 13 |
| 4 | 60 | 40 | — | 25 |
| 5 | — | 50 | 50 | n.a |
| 6 | — | 60 | 40 | n.a |

Underlined values: not corresponding to the invention n.a: Non-Assessed Value

The surface fractions of phases in the microstructure are determined through the following method: a specimen is cut from the hot rolled, polished and etched with a reagent known per se, to reveal the microstructure. The section is afterwards examined through scanning electron microscope, for example with a Scanning Electron Microscope with a Field Emission Gun ("FEG-SEM") at a magnification greater than 5000×, in secondary electron mode.

The determination of the surface fraction of austenite films and M-A islands is performed thanks to SEM observations after Nital or Picral/Nital reagent etching.

According to the present invention, the lath bainite will be a bainite having an aspect ratio above or equal to 3. According to the invention the M-A islands have an aspect ratio below or equal to 2.

TABLE 4

Mechanical properties of the hot rolled steel sheet
Mechanical properties of the tested samples were determined and gathered in the following table:

| Trial | Charpy impact energy (J/mm$^2$) | TS (MPa) | UE (%) | TE(%) |
|---|---|---|---|---|
| 1 | 0.89 | n.a | n.a | n.a |
| 2 | 0.81 | 1492 | 6.6 | 11 |
| 3 | 0.76 | 1522 | 7.4 | 11 |
| 4 | 0.82 | 1485 | 4.1 | 7 |
| 5 | 0.31 | n.a | n.a | n.a |
| 6 | 0.16 | n.a | n.a | n.a |

Underlined values: do not match the targeted values n.a: non-assessed value

TABLE 5

| Weldability properties of the hot rolled steel sheet Weldability properties of some samples were determined and gathered in the following table: | | |
|---|---|---|
| Trial | α (daN/mm²) | Plug ratio (%) |
| 1 | 66 | 84 |
| 5 | 45 | 77 |
| 6 | 47 | 70 |

Underlined values: do not match the targeted values

The examples show that the steel sheets according to the invention, namely examples 1-3 are the only one to show all the targeted properties thanks to their specific composition and microstructures.

In trial 4, the steel sheet is hot rolled with a FRT of 910° C., leading to a high fraction of martensite and M-A islands. This leads to a uniform elongation lower than 5%.

The absence of boron in steels C and D leads to low level of Charpy impact energy in trials 5 and 6, with formation of more than 30% of granular bainite, decreasing the fracture toughness of the steel. Regarding the weldability parameters, the absence of boron, molybdenum and aluminum is detrimental for a and the plug ratio.

What is claimed is:

1. A hot-rolled steel sheet, made of a steel having a composition comprising, by weight percent:

C: 0.10-0.25%
Mn: 3.5-5.0%
Si: 0.80-1.60%
B: 0.0003-0.004%
S≤0.010%
P≤0.020%
N≤0.008% and optionally one or more of the following elements, in weight percentage:

Ti≤0.04%
Nb≤0.05%
Mo≤0.3%
Al≤0.90%
Cr≤0.80% a remainder of the composition being iron and unavoidable impurities;

the steel sheet having a microstructure including, in surface fraction;

from 50% to 80% of lath bainite with an aspect ratio above or equal to 3, less than 30% of granular bainite with an aspect ratio below 3, martensite, martensite-austenite M-A islands having an aspect ratio below or equal to 2, and austenite films, a sum of the martensite, the martensite-austenite M-A islands and the austenite films being from 15% to 35%, and less than 20% of the martensite and the M-A islands having a multiplication of the maximum length $L_{max}$ of the grain by the maximum width $W_{max}$ of the grain higher than 1 μm².

2. The hot rolled steel sheet as recited in claim 1 wherein the manganese content is between 3.5% and 4.5%.

3. The hot rolled steel sheet as recited in claim 1 wherein the silicon content is between 1.00% and 1.60%.

4. The hot rolled steel sheet as recited in claim 1 wherein the hot-rolled steel sheet has Charpy impact energy at 20° C. strictly higher than 0.50 J/mm².

5. The hot rolled steel sheet as recited in claim 1 wherein the hot-rolled steel sheet has tensile strength TS above or equal to 1450 MPa.

6. The hot rolled steel sheet as recited in claim 1 wherein the hot-rolled steel sheet has uniform elongation UE above or equal to 5%.

7. A resistance spot weld of two steel parts of the hot rolled steel sheet as recited in claim 1, the resistance spot weld having an α value of at least 50 daN/mm² and a plug ratio of at least 80%.

8. The hot rolled sheet of claim 1, wherein the microstructure consists of, in surface fraction: from 50% to 80% of lath bainite with an aspect ratio above or equal to 3, less than 30% of granular bainite with an aspect ratio below 3, martensite, martensite-austenite M-A islands having an aspect ratio below or equal to 2, and austenite films.

9. The hot rolled sheet of claim 1, wherein the microstructure consists of, in surface fraction: from 50% to 80% of lath bainite with an aspect ratio above or equal to 3, martensite, martensite-austenite M-A islands having an aspect ratio below or equal to 2, and austenite films.

10. A method for manufacturing a hot-rolled steel sheet, comprising the following successive steps:

casting a steel to obtain a semi-finished product having a composition including, by weight percent:

C: 0.10-0.25%
Mn: 3.5-5.0%
Si: 0.80-1.60%
B: 0.0003-0.004%
S≤0.010%
P≤0.020%
N≤0.008% and optionally one or more of the following elements, in weight percentage:

Ti≤0.04%
Nb≤0.05%
Mo≤0.3%
Al≤0.90%
Cr≤0.80% a remainder of the composition being iron and unavoidable impurities resulting from the processing;

reheating the semi-product at a temperature $T_{reheat}$ between 1150° C. and 1300° C.;

hot rolling the semi-product with a finish hot rolling temperature between 750° C. and 900° C. to obtain a hot-rolled steel sheet;

cooling the hot rolled steel sheet; and coiling the hot rolled steel sheet at a coiling temperature $T_{coil}$ comprised between (Ms−100° C.) and 550° C. so to obtain the coiled steel sheet as recited in claim 1.

11. A resistance spot weld of two steel parts of the hot rolled steel sheet obtained through the method as recited in claim 10, the resistance spot weld having an α value of at least 50 daN/mm² and a plug ratio of at least 80%.

* * * * *